US007178889B2

(12) United States Patent
Hoshide et al.

(10) Patent No.: US 7,178,889 B2
(45) Date of Patent: Feb. 20, 2007

(54) SLIDE RAIL

(75) Inventors: Kaoru Hoshide, Tokyo-to (JP); Akira Sato, Tokyo-to (JP); Minoru Kouchi, Tokyo-to (JP); Soichi Sasaki, Tokyo-to (JP)

(73) Assignee: THK, Co., Ltd., Tokyo-to (JP)

( * ) Notice: Subject to any disclaimer, the term of this patent is extended or adjusted under 35 U.S.C. 154(b) by 16 days.

(21) Appl. No.: 10/878,205

(22) Filed: Jun. 29, 2004

(65) Prior Publication Data

US 2005/0012440 A1 Jan. 20, 2005

(30) Foreign Application Priority Data

Jul. 15, 2003 (JP) ..... P2003-197393

(51) Int. Cl.
*A47B 88/04* (2006.01)

(52) U.S. Cl. ..... 312/334.7; 312/334.1

(58) Field of Classification Search ..... 312/330.1, 312/333, 334.1, 334.7, 334.11, 334.17; 384/18, 384/42, 45

See application file for complete search history.

(56) References Cited

U.S. PATENT DOCUMENTS 459,199 A * 9/1891 Erben ..... 126/18
2,891,834 A * 6/1959 Lake ..... 312/307
3,026,149 A * 3/1962 Ruhnke ..... 384/19
3,243,247 A * 3/1966 Knape ..... 312/333
3,295,903 A * 1/1967 Middleton ..... 312/246
3,351,404 A * 11/1967 Blake ..... 312/246
3,460,876 A * 8/1969 De Boer ..... 312/246
3,586,394 A * 6/1971 Hecksel ..... 384/23
3,694,048 A * 9/1972 Middleton ..... 312/246
3,966,273 A 6/1976 Hagen et al.
4,447,095 A * 5/1984 Fielding ..... 384/19
4,569,563 A * 2/1986 Fourrey ..... 384/49
5,308,170 A * 5/1994 Yamaguchi et al. ..... 384/45

FOREIGN PATENT DOCUMENTS

| | | |
|---|---|---|
| DE | 25 40 656 | 3/1976 |
| GB | 1 512 069 | 5/1978 |
| JP | 51-048046 | 4/1976 |

* cited by examiner

*Primary Examiner*—James O. Hansen
(74) *Attorney, Agent, or Firm*—Westerman, Hattori, Daniels & Adrian, LLP.

(57) ABSTRACT

A slide rail unit for guiding an object to be pulled out, such as drawer, from a body, such as furniture or desk, in which the object is slidably accommodated includes a body side rail provided for the body, and an object (i.e., drawer) side rail provided for the object to be pulled out to be slidable relative to the body side rail. The body side rail and the object side rail each has a portion bent in a circular-arc shape so that the object is pulled out along a circular-arc locus.

16 Claims, 8 Drawing Sheets

SLIDE RAIL

BACKGROUND OF THE INVENTION

1. Field of the Invention

The present invention relates to a slide rail (or slide rail unit) for smoothly guiding a pulling or drawing motion of an object, such as drawer, to be pulled out from a body structure such as furniture, desk or like.

2. Related Art

A slide rail (unit) is known as a member which is attached to, for example, a drawer of a furniture, desk or like so as to allow the drawer to be easily and smoothly opened or closed. Such slide rail is disclosed, for example, in Japanese Patent Laid-open (KOKAI) Publication No. SHO 51-048046. This Japanese Patent Laid-open (KOKAI) Publication No. SHO 51-048046 corresponds to DE 2540656, GB 1512069, and U.S. Pat. No. 3,966,273. The disclosure of U.S. Pat. No. 3,966,273 is incorporated by reference in its entirety The slide rail is generally composed of an outer rail (member) and an inner rail (member) which is fitted to the outer rail. A number of balls are disposed between these outer and inner rails. In general, the outer rail is attached to a body structure of furniture, for example, and the inner rail is attached to the drawer. Further, it is to be noted that the slide rail unit is mentioned herein as slide rail which is generally composed of the outer rail and the inner rail. In this structure, when an external force is applied to the inner rail, the balls roll between the inner and outer rails, and the inner rail is therefore slid with respect to the outer rail. Further, in order to make large a stroke of the inner rail, it is necessary to design the inner rail so as to have a length as long as that of the outer rail.

Generally, in the conventional slide rail (unit) of the structure mentioned above, both the inner and outer rails have linear shape, and the drawer is hence pulled out linearly. In such linear structure, when the drawer is pulled out linearly, there may cause a case that the drawer collides with an obstacle or the drawer cannot be easily pulled out, thus being inconvenient.

SUMMARY OF THE INVENTION

It is therefore an object of the present invention to substantially eliminate defects or drawbacks encountered in the prior art as mentioned above, and to provide a slide rail (unit) having a sliding locus of a drawer different from that of conventional structure having a linear sliding locus.

This and the other objects can be achieved according to the present invention by providing a slide rail unit for guiding an object to be pulled out from a body in which the object is slidably accommodated, comprising:

a body side rail provided for the body; and an object side rail provided for the object to be pulled out to be slidable relative to the body side rail, the body side rail and the object side rail each having a portion bent in a circular-arc shape so that the object is pulled out along a circular-arc locus.

According to the present invention, an object to be pulled out can be pulled out along a circular arc locus, for example, in a vertical plane or in a horizontal plane, based on a method by which a slide rail is mounted on a body.

In a preferred embodiment of this aspect, the slide rail unit comprises:

an outer rail constituting one of the body side rail and the object side rail for the object to be pulled out, the outer rail being composed of a bottom wall section extending in circular-arc shape in a longitudinal direction thereof and a pair of side wall sections formed, in a bent form, on both side ends in the short length direction of the bottom wall section so as to extend in circular-arc shape in the longitudinal direction thereof to thereby form a rolling member rolling portion;

an inner rail constituting another one of the body side rail and the object side rail so as to be fitted to the outer rail, the inner rail being composed of a bottom wall section extending in parallel to the bottom wall section of the outer rail and a pair of side wall sections formed, in a bent form, on both side ends in the short length direction of the bottom wall section so as to extend in circular-arc shape in the longitudinal direction thereof to thereby form a rolling member rolling portion; and a number of rolling members disposed between the rolling member rolling portion of the outer rail and the rolling member rolling portion of the inner rail.

The outer rail may be bent in the circular-arc shape in a virtual plane including the bottom wall section of the outer rail, and the inner rail is bent in the circular-arc shape in a virtual plane including the bottom wall section of the inner rail.

The outer rail may be bent in the circular-arc shape in a virtual plane perpendicular to the bottom wall section of the outer rail, and the inner rail is bent in the circular-arc shape in a virtual plane perpendicular to the bottom wall section of the inner rail.

The inner rail has a cross sectional shape corresponding to an inverted shape for a cross section of the outer rail, and the inner rail is fitted to the outer rail to thereby define a rolling member rolling path therebetween.

The rolling members may be balls.

Each of the body side rail and the object side rail may have a linear portion continuous to the circular-arc portion.

The circular-arc locus may have a predetermined radius of curvature.

Further, it is to be noted that the slide rail will be bent in two ways or manners and, that is, one may be called "sword or horizontally bent form" and the other one may be called "belly or vertically bent form". In the "sword or horizontally bent form", the outer rail is bent in the circular-arc shape in a virtual plane including the bottom wall section of the outer rail, and, also, the inner rail is bent in the circular-arc shape in a virtual plane including the bottom wall section of the inner rail. On the other hand, in the "belly or vertically bent form", the outer rail is bent in the circular-arc shape in a virtual plane perpendicular to the plane including the bottom wall section of the outer rail, and, also, the inner rail is bent in the circular-arc shape in a virtual plane perpendicular to the plane including the bottom wall section of the inner rail.

According to the structure of the slide rail unit mentioned above, the object to be pulled out, such as drawer for furniture, desk or like, can be pulled out along the circular-arc locus, not a conventional linear locus. Therefore, it becomes possible to attach the slide rail to the body in which the object is slidably accommodated in various ways, and for example, the drawer can be pulled out along the circular-arc locus in the vertical plane or in the horizontal plane, thus being advantageous.

The nature and further characteristic features of the present invention will be made more clear from the following descriptions made with reference to the accompanying drawings.

BRIEF DESCRIPTION OF THE DRAWINGS

In the accompanying drawings:

FIG. 1 represents a first embodiment of a slide rail (unit) according to the present invention, showing a state in which an inner rail is accommodated, in which

FIG. 2 also represents the first embodiment of the slide rail (unit) according to the present invention, showing a state in which an inner rail is pulled out, in which

FIG. 3 represents a second embodiment of a slide rail (unit) according to the present invention, showing a state in which an inner rail is accommodated, in which

FIG. 4 also represents the second embodiment of the slide rail (unit) according to the present invention, showing a state in which an inner rail is pulled out, in which

FIG. 7 represents a case in which the drawer is pulled out along a circular arc locus in a horizontal plane, in which

FIG. 9 represents an example in which a drawer having a usual structure is pulled out along a circular-arc locus in a horizontal plane, in which

FIG. 10 represents an example in which the drawer is pulled out along the circular-arc locus in a vertical (perpendicular) plane, in which

FIG. 12 represents an example in which a panel is pulled out along the circular-arc locus in the vertical plane, in which

FIG. 13 represents an example in which a linear slide rail and a circular-arc slide rail are combined, in which FIG. 14 represents an example in which a linear slide rail and a circular-arc slide rail are combined, in which

DESCRIPTION OF THE PREFERRED EMBODIMENT

Preferred embodiments of a slide rail (unit) according to the present invention will be described hereunder with reference to the accompanying drawings.

Figure 1A:
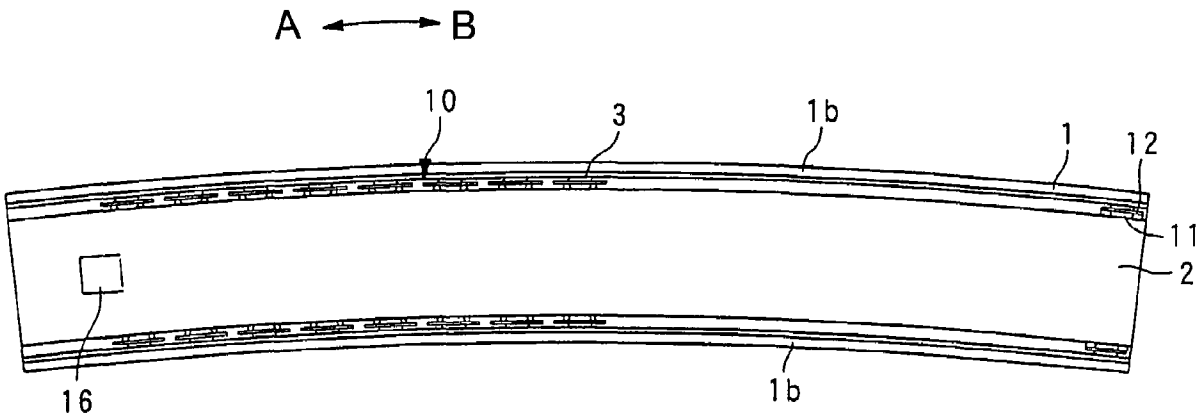
FIG. 1A shows a plan view of the slide rail.
Figure 1B:
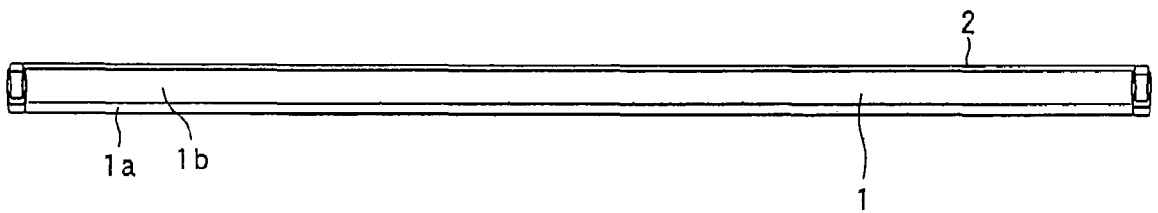
FIG. 1B shows a side view thereof.
Figure 1C:
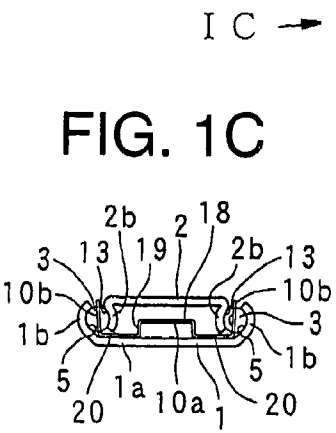
FIG. 1C is a view seen from a direction of an arrow IC in FIG. 1A.
Figure 2A:
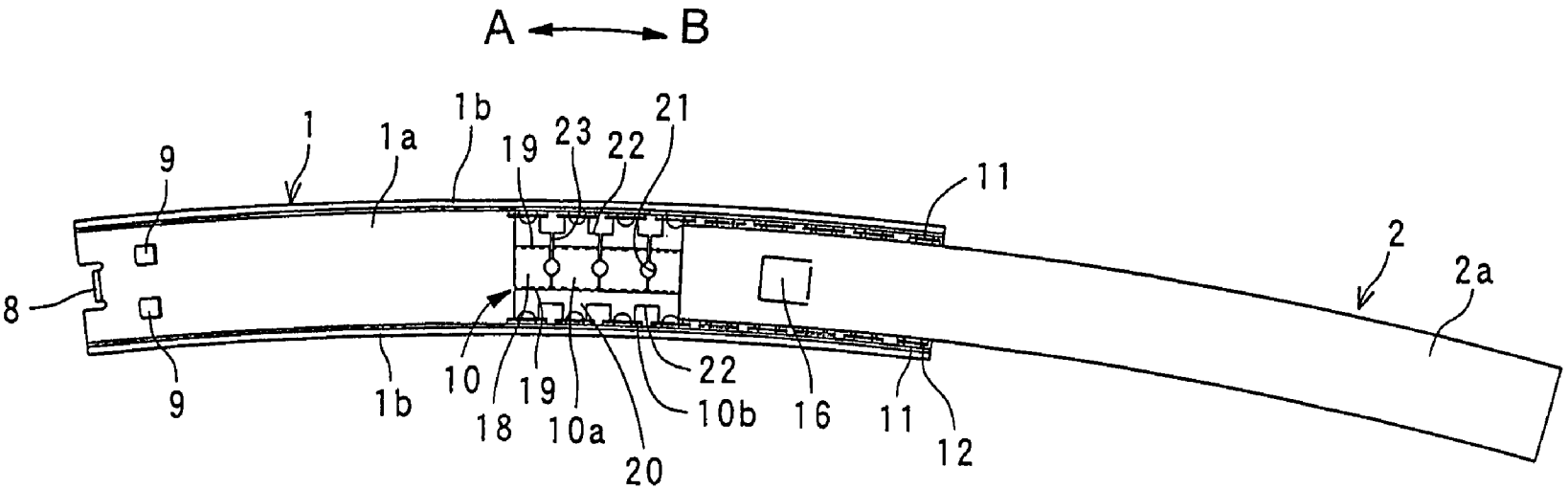
FIG. 2A shows a plan view of the slide rail.
Figure 2B:
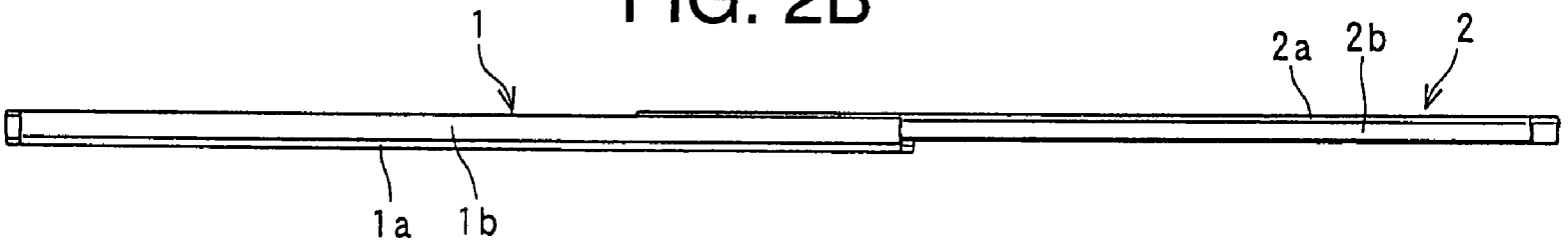
FIG. 2B shows a side view thereof.

First, with reference to FIGS. 1 and 2 representing a first embodiment of the present invention, a slide rail is generally a metal article for smoothly opening or closing an object to be pulled out, and for example, the slide rail is attached or mounted to a drawer or drawers of a system kitchen, a sink cabinet, a furniture such as chiffonier, dresser, system furniture or like. The slide rail (unit) includes an outer rail (member) 1, an inner rail (member) 2, and a number of balls 3 disposed between the outer and inner rails 1 and 2 so as to be capable of rolling therealong. FIG. 1 shows a state in which the inner rail 2 is accommodated and, on the other hand, FIG. 2 shows a state in which the inner rail 2 is pulled out.

The outer rail 1 has a channel-shaped cross section, and is composed of a bottom wall section 1*a* extending in a longitudinal direction, and a pair of side wall sections 1*b* bent at both sides in a short length (width) side direction of the bottom wall section 1*a*. Each of the paired side wall sections 1*b* has a cross section, in form of circular-arc, protruding outward. Inside wall surfaces, opposing to each other, of the paired side wall sections 1*b* are formed with ball rolling portions 5, as rolling member rolling portions, extending in the longitudinal direction of the outer rail 1.

In the illustrated embodiment, the outer rail 1 is bent so as to provide a circular-arc shape having a constant radius of curvature in a virtual plane (shown plane) including the bottom wall section 1*a*, this bending state being called "sword or horizontally bent form". In other wards, the outer rail 1 is bent around an axis perpendicular to the bottom wall section 1*a*. Accordingly, the paired side wall sections 1*b* opposing to each other are bent or curved in form of circular-arc shape with a constant interval being maintained, and the paired ball rolling grooves 5, opposing to each other, are also curved so as to provide the circular-arc shape with a constant interval being maintained. The bottom wall section 1*a* of the outer rail 1 is formed with a plurality of holes 7 (see FIG. 4) with a constant interval in the longitudinal direction, into which fastening means such as screws or like are fitted to thereby secure the outer rail 1 to the drawer or the body structure such as furniture.

The outer rail 1 has one longitudinal end at which a rail stopper 8 is formed as shown in FIG. 2 (FIG. 2A) which is formed by bending the end portion of the outer rail 1 at right angles with respect to the bottom wall section 1*a*. This rail stopper 8 abuts against the inner rail 2 moving in the pull-in (accommodating) direction "A" so as to stop the inner rail 2 at its pulled-in state shown in FIG. 1. As also shown in FIG. 2A, a retainer stopper 9 is formed at a portion near the rail stopper 8, and this retainer stopper 9 is composed of shallow protruded or recessed portions formed through an emboss working, for example. This retainer stopper 9 abuts against a retainer 10 (see FIG. 2A) to thereby stop the retainer 10 at its pull-in state shown in FIG. 1.

The outer rail 1 has the other longitudinal end portion at which lead balls 11 are arranged, the lead balls 11 being formed of resin material or the like for guiding the inner rail 2 pulled out from the outer rail 1. These lead balls 11 are fitted in the ball rolling portions 5 formed to the outer rail 1, and supported by brackets 12 fixed to the inside portions of the outer rail 1 so as not to be slid with respect to the outer rail 1.

The inner rail 2 having a groove shape corresponding to the inverted shape of the grooved cross section of the outer rail 1 is fitted to the inside portion of the outer rail 1 to be slidable with respect thereto. The inner rail 2 has a longitudinal length which is substantially the same as that of the outer rail 1.

The inner rail 2 has a groove shaped cross section, and is composed of a bottom wall section 2*a* extending in its longitudinal direction, and a pair of sidewall section 2*b* bent at both sides in a short length (width) side direction of the bottom wall section 2*a*. Each of the paired side wall sections 2*b* has a cross section, in form of circular-arc, protruding inward. Outside wall surfaces, opposing to each other, of the paired side wall sections 2*b* are formed with ball rolling portions 13, as rolling member rolling portions, extending in the longitudinal direction of the inner rail 2.

In the illustrated embodiment, the inner rail 2 is bent so as to provide a circular-arc shape having a constant radius of curvature in a virtual plane including the bottom wall section 2*a* so as to provide the so-called "sword or horizontally bent form". Accordingly, the paired sidewall sections 2*b* opposing to each other are also bent or curved in form of circular-arc shape with a constant interval being maintained, and the paired ball rolling portions 13, opposing to each other, are also bent so as to provide the curved circular-arc shape with a constant interval being maintained. The bottom wall section 2*a* of the inner rail 2 is formed with a plurality of holes 15 (see FIG. 4) with a constant interval in the longitudinal direction, into which fastening means such as screws or like are fitted thereby to secure the inner rail 2 to the drawer or the body structure such as furniture.

The inner rail 2 has one longitudinal end, corresponding to one end of the outer rail 1 at which the rail stopper 8 is formed, at which a claw 16 is formed so as to project towards the bottom wall section 1*a* of the outer rail 1. The claw 16 is engaged with the rail stopper 8 to stop the movement of the inner rail 2 in its pull-in state as shown in FIG. 1. As also shown in FIG. 2A, a drawer stopper, not shown, is provided at the other longitudinal end of the bottom wall section 2*a* of the inner rail 2 so as to collide with a claw, not shown, formed on the bracket 12 of the outer rail 1 to thereby stop the movement of the inner rail 2 in its pull-out state (state in FIG. 2).

A plurality of balls 3 as rolling members are disposed between the ball rolling portions 13 formed at the side wall sections 2*b* of the inner rail 2 and the ball rolling portions 13 formed at the side wall sections 1*b* of the outer rail 1. A series of these balls 3 are held to be rolled by the retainer 10.

The retainer 10 has a thin thickness, and is composed of a bottom wall section 10*a* extending in the longitudinal direction thereof, and a pair of arm sections 10*b* bent at both end portions of the bottom wall section 10*a* in the short length(width) direction. A series of balls 3 are held between the paired arm sections 10*b* connected to the bottom wall section 10*a* and the ball rolling portions 5 of the outer rail 1, so that the balls 3 are not came off therefrom even if the inner rail 2 is disassembled from the outer rail 1. The bottom wall section 10*a* of the retainer 10 is provided with an inverted groove-shaped portion 18 extending in the longitudinal direction of the retainer 10, and connecting portions 20 connecting the sidewall portions 19 of the inverted groove-shaped portion 18 and the arm-shaped side portions 10*b*, respectively. This inverted groove-shaped portion 18 is provided for the purpose of preventing interference of the retainer 10 with a screw head or the like of a screw at a time when the outer rail 1 is secured to the drawer or the body therefor by using the screw or the like, or for ensuring the strength of the retainer 10. The inverted groove-shaped portion 18 is formed with holes 21 at a constant pitch in the longitudinal direction for easy press working of the retainer 10.

As mentioned hereinbefore, a number of balls 3 are held by the arm-shaped side wall sections 10*b* of the retainer 10 so as to be capable of rolling in the longitudinal direction thereof with equal intervals. One and the other arm-shaped side wall sections 10*b*, 10*b* of the retainer 10 are arranged in parallel to each other so as to be perpendicular to the inverted groove-shaped portion 18. The arm-shaped side wall sections 10*b* are formed with openings for receiving the ball 3, and hence, the opening has a diameter slightly smaller than that of the ball 3.

Cutouts 22 are formed, between adjacent balls 3, 3, to the arm-shaped side wall sections 10*b* and the connecting portions 20. Slits 23 are formed to be continuous to the cutouts 22 so as to extend in the width(short length) direction of the inverted groove portion 18 to a portion passing through one of the side wall portions 19 of the inverted groove portion 18 and the bottom portion thereof. These slits 23 are formed so as to easily bend the retainer 10 in a circular-arc shape to accord with the circular-arc curve of the outer rail 1. Namely, when it is intended to bend the retainer 10 in a plane including the bottom portion of the inverted groove-shaped portion 18, a large sectional secondary moment is caused and, hence, the retainer 10 cannot be easily bent. However, in the structure formed with such slits 23, only a portion of each of the side wall portions 19 of the inverted groove portion 18 and the connecting portion 20 are bent, so that the bending working can be easily done.

Further, it may be possible to manufacture a retainer 10 having a curved structure in conformity with the curve of the outer rail 1 through a press working without forming such slits 23. The retainer 10 may be formed of a resin material through a resin molding process. In addition, the shape of the retainer 10 is not limited to such shape, but the retainer 10 may be formed so as to provide various shapes as far as it is provided with holding function of ball 3.

When an external force is applied to the inner rail 2 from its longitudinal direction with the outer rail 1 being fixed, the balls 3 roll, and the inner rail 2 slides in its longitudinal direction with respect to the outer rail 1. In this moment, the balls 3 roll in the space between the ball rolling portion 5 of the outer rail 1 and the ball rolling portion 13 of the inner rail 2 to move by a distance corresponding to half of displacement of the inner rail 2. The retainer 10 also moves by a distance equal to a displacement of the ball 3. On the other hand, the lead ball 11 maintains its constant position on the outer rail 1 even if the inner rail 2 is slid with respect to the outer rail 1. Thus, the inner rail 2 is slid with respect to the outer rail 1 while being held by the lead ball 11 and the ball 3 held by the retainer 10.

These inner and outer rails 2 and 1 can be slid with respect to each other in the longitudinal direction thereof. Further, since these outer and inner rails 1 and 2 are bent in a circular-arc shape, the inner rail 2 (hence, the drawer) is also moved so as to describe the circular arc locus. Therefore, when, for example, the slide rail having the "sword or horizontally bent form" is mounted to the portion between the side surface of the drawer and the side surface of the body, the drawer is moved so as to describe the circular-arc locus (trace or path) in the vertical plane.

Figure 3A:
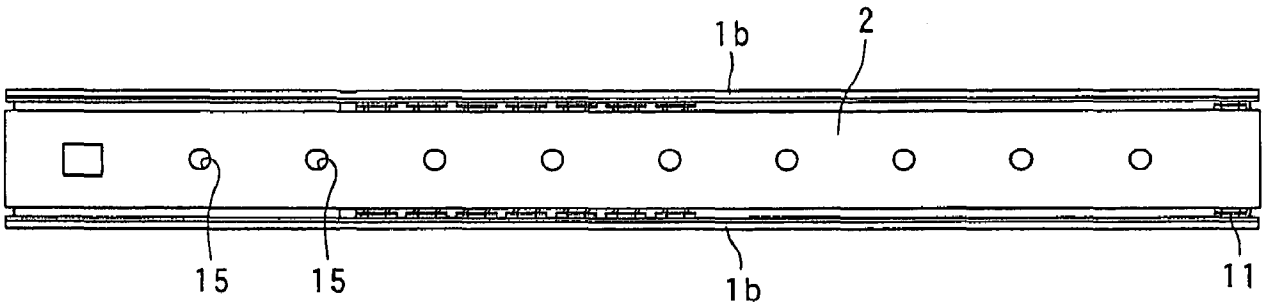
FIG. 3A shows a plan view of the slide rail.
Figure 3B:
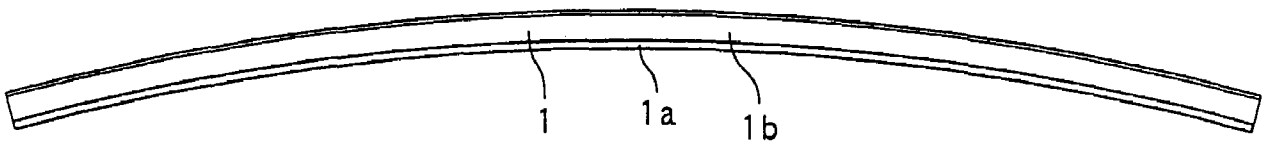
FIG. 3B shows a side view thereof.
Figure 3C:
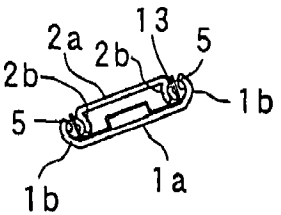
FIG. 3C is a view seen from a direction of an arrow IIIC.
Figure 4A:
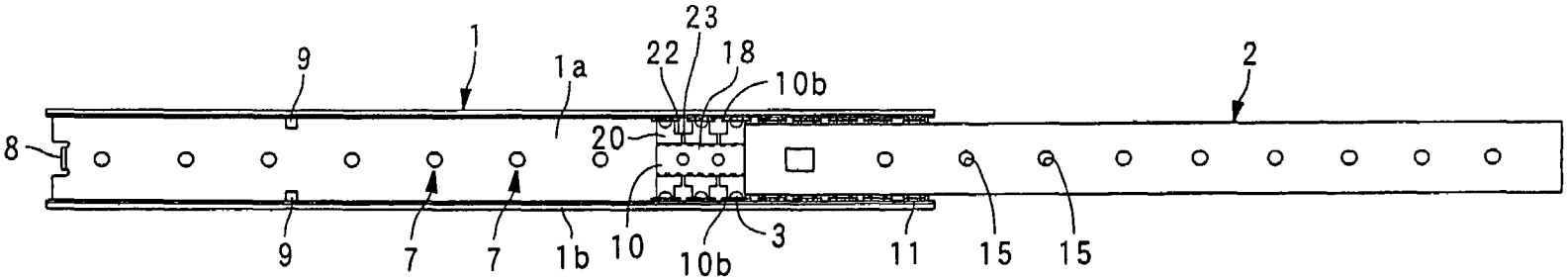
FIG. 4A shows a plan view of the slide rail.
Figure 4B:
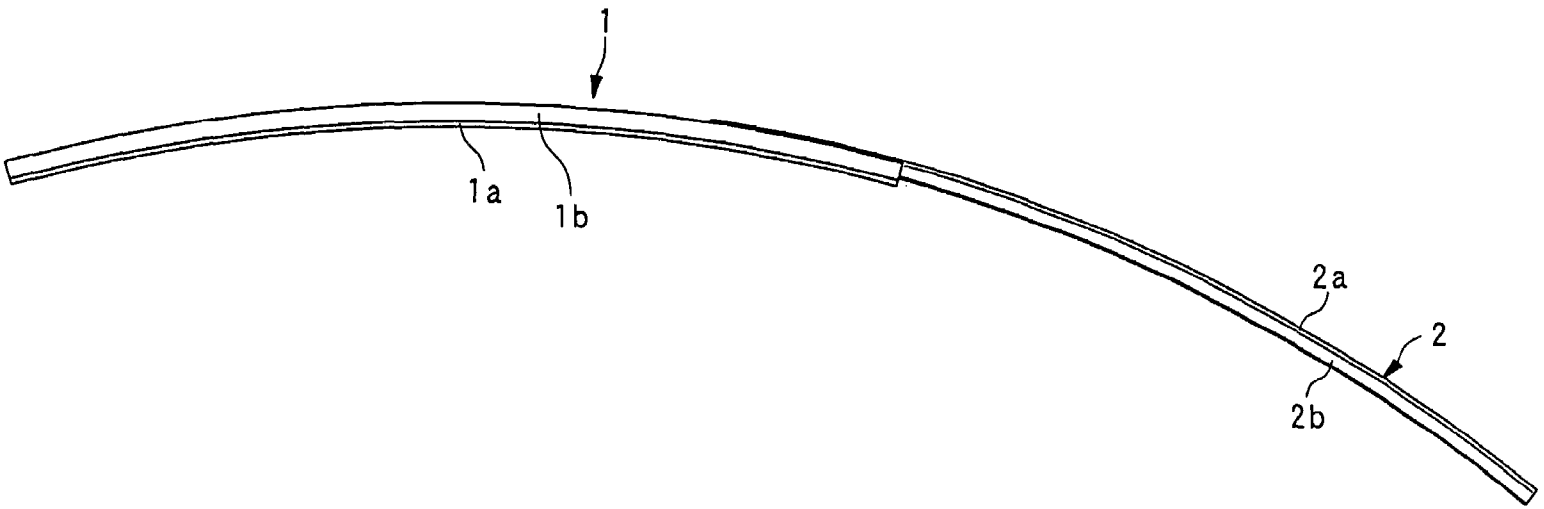
FIG. 4B shows a side view thereof.

FIGS. 3 and 4 show a slide rail according to the second embodiment of the present invention. FIG. 3 shows the state in which the inner rail 2 is accommodated, and FIG. 4 shows the state in which the inner rail 2 is pulled out.

The second embodiment differs from the first embodiment in the curved structure of the outer and inner rails 1 and 2, and the other structures are substantially the same as those of the first embodiment, so that the like reference numerals are added to the corresponding portions, and explanations thereof are omitted herein. In this second embodiment, the outer rail 1 is bent in the circular-arc shape in a virtual plane perpendicular to the bottom wall section 1*a* of the outer rail 1 (i.e., in a plane shown in FIG. 3B (FIG. 4B)), and the inner rail 2 is also bent in the circular-arc shape having a constant radius of curvature in a virtual plane perpendicular to the bottom wall section 2*a* of the inner rail 2 (this bending state being called "belly or vertically bent form"). In other wards, it may be said that the outer and inner rails 1 and 2 are bent around an axis parallel to the bottom wall sections 1*a* and 2*a* of the outer and inner rails 1 and 2. Further, the respective paired side wall sections 1*b* and 2*b* of the outer and inner rails 1 and 2 are also bent in the circular-arc shapes with the constant intervals being maintained therebetween. Moreover, the paired ball rolling portions 5 and 13 are also bent in the circular-arc shapes with the constant intervals being maintained therebetween.

The retainer 10 is bent, in accordance with the bent condition of the outer rail 1, in a plane perpendicular to the bottom portion of the inverted groove-shaped portion 18 of the retainer 10. With this structure, in comparison with the retainer 10 of the first embodiment mentioned above, the secondary moment of the section of the retainer 10 becomes small. In this matter, it may be possible to form a slit 23 extending in the short longitudinal (width) direction, to one side wall section 19 of the inverted groove shape portion 18, to be continuous to the cutout 22 in the connection portion 20 of the retainer 10. In this case, it is also possible to change the material, shape and so on of the retainer 10 in the same manner as the first embodiment.

In this second embodiment, the inner rail 2 and the outer rail 1 are also both slidable in their longitudinal directions. Since both these outer and inner rails 1 and 2 are bent so as to provide the circular-arc shape, the locus of the inner rail 2 is also circular-arc shape, as well as the locus of the drawer. For example, in a case in which a slide rail, of the "belly or vertically bent form", is attached to a portion between the side portion of the drawer and the side portion of the body, the drawer describes the circular-arc locus (trace or path) in the horizontal plane.

Figure 5:
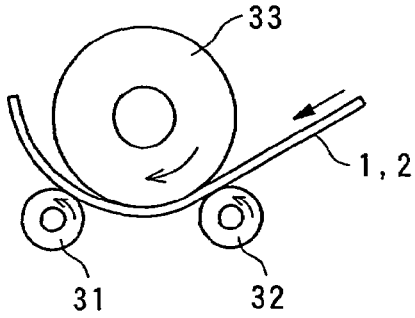
FIG. 5 is an illustration showing a state in which an inner rail and an outer rail of the slide rail are bent by means of bending roll.

In the followings, a manufacturing method of the outer rail 1 and the inner rail 2 of the slide rail unit of the structure mentioned above will be described. FIG. 5 represents an example of the manufacture of the slide rail by using a working machine called "bending roll" (angle bender) for bending the outer rail 1 and the inner rail 2.

First, an outer rail 1 and an inner rail 2 preliminarily formed so as to have linear shape are prepared. In this stage of the manufacture, the outer and inner rails 1 and 2 had already been formed so as to provide a groove shaped section. Next, a plurality of rolls 31, 32, and 33, which are arranged so that the axes thereof are in parallel to each other, are prepared, and the linear outer rail 1 is rolled by reciprocally passing, by several times, through a gap between the roll 33 and roll 32 and, then, a gap between the roll 33 and 31 by rotation of the rolls 31,32, and 33, as shown in FIG. 5 to thereby bend the outer rail 1 into a circular-arc shape. In the same manner, the linear inner rail 2 is reciprocally rolled by several times between these rolls 33 and 32 and rolls 33 and 31 by rotation of the rolls 31,32, and 33 to thereby bend the inner rail 2 into a circular-arc shape. It is, of course, possible to first bend the inner rail 2 and then bend the outer rail 1.

The outer rail 1 and the inner rail 2 both have a groove-shaped sectional view, and there is a fear that the side wall sections 1*b* and 2*b* of these rails 1 and 2 may be bent inward at the time when both the rails are bent by using the bending roll. If the side wall sections 1*b* and 2*b* are bent inward, there may also cause a fear that it is difficult to locate the balls 3, 3, . . . , 3 between the ball rolling portion 5 of the side wall section 1*b* of the outer rail 1 and the ball rolling portion 13 of the side wall section 2*b* of the inner rail 2. In order to obviate such fear, an inclusion or intervening member having a shape according with the shape of the groove of the outer rail 1 is fitted to the outer rail 1 so as to suppress the reduction of the distance between the paired side wall sections 1*b* thereof at the time when passing through the gaps between the rolls 33 and 32 and the rolls 33 and 31. In the like manner, an inclusion or intervening member having a shape according with the shape of the groove of the inner rail 2 is fitted to the inner rail 2 so as to suppress the reduction of the distance between the paired side wall sections 2*b* thereof at the time when passing through the gaps between the rolls 33 and 32 and the rolls 33 and 31. These inclusions or intervening members are formed of soft resin material such as polyvinyl chloride. These inclusions or intervening members can be also bent by using the bending roll in the same manner as the outer rail 1 and the inner rail 2.

As described above, by using such bending roll, the outer and inner rails 1, 2 having various sizes and bending radius of curvatures can be manufactured.

Figure 6:
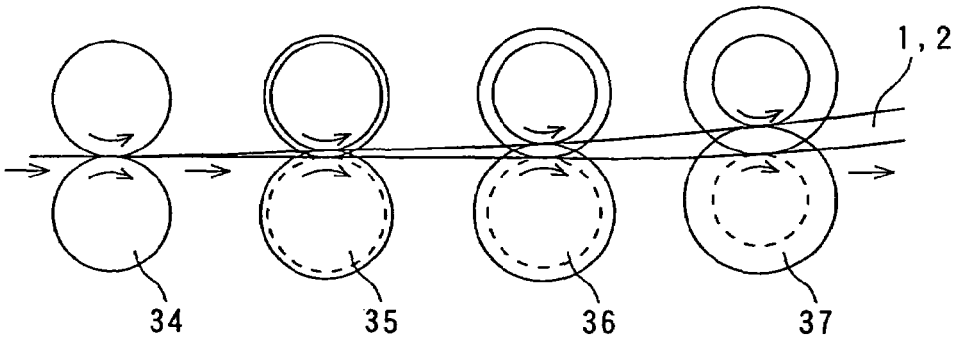
FIG. 6 shows a schematic sequence for bending the outer rail and the inner rail by a roll forming method.

FIG. 6 represents one example of manufacturing the outer and inner rails through a roll forming method. In this example, a flat member is guided between a plural pairs of shape rolls 34 to 37, and according to the passing from the front (first) roll to the subsequent (second, third, . . . ) rolls, the outer rail 1 (or inner rail 2) is gradually shaped so as to provide a groove-shaped cross section. During this rolling process, the outer rail 1 or inner rail 2 is bent so that the inner rail 2 provides the circular-arc locus with respect to the outer rail 1. With circular-arc arrangement of the plural shape rolls 34 to 37 in the perpendicular plane as shown in FIG. 6, the "belly or vertically bent formed" outer rail 1 or inner rail 2 can be provided, while forming the groove-shaped structure. Further, with the circular-arc arrangement of the plural shape rolls 34 to 37 in the horizontal plane, the "sword or horizontally bent formed" outer rail 1 or inner rail 2 could be provided.

The outer rail 1 and the inner rail 2 may be manufactured by a method other than the method mentioned hereinbefore such as, for example, a press working, which will be suitable for the manufacture of a rail having a predetermined length and predetermined radius of curvature.

Figure 7A:
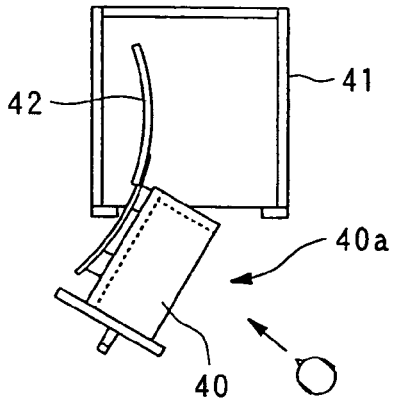
FIG. 7A is a top plan view thereof.
Figure 7B:
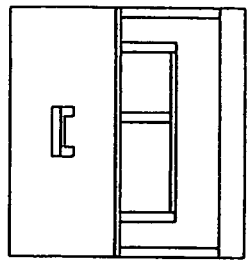
FIG. 7B is a front view thereof.

The slide rail (unit) of the first and second embodiment mentioned above can be used in the following manner. FIG. 7 (7A, 7B) shows an example in which the drawer is pulled out along the circular-arc locus in the horizontal plane, and FIG. 7A is a top plan view thereof, and FIG. 7B is a front view thereof. A slide rail 42 is mounted to the side surface of a drawer 40 such as shelf and the side surface of a body 41 to which the drawer 40 is slidably mounted. When a user pulls out the drawer 40, the drawer 40 moves along the circular-arc locus in the horizontal plane. In this example, it should be understood that the opened side 40*a* of the pulled-out drawer 40 will be easily observed by the user.

Figure 8:
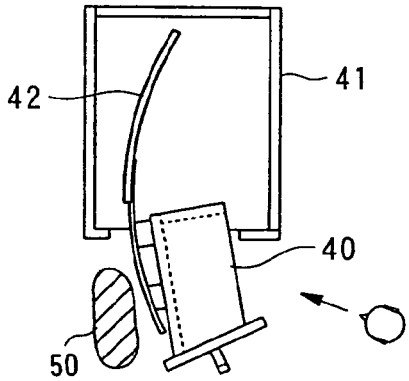
FIG. 8 is an illustrated top plan view showing a state in which the drawer is pulled out along a circular-arc locus in a horizontal plane.

FIG. 8 also shows an example in top plan in which the drawer 40 is pulled out along the circular-arc locus in the horizontal plane. In this example, the slide rail 42 is also mounted to the side surface of the drawer 40 such as shelf and the side surface of the body 41. When a user pulls out the drawer 40, the drawer 40 moves along the circular-arc locus in the horizontal plane so as to avoid an obstacle 50 existing on the linear path, thus preventing the drawer 40 from colliding with the obstacle 50.

Figure 9A:
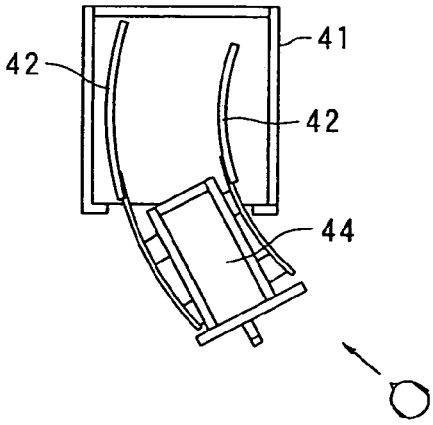
FIG. 9A shows a slide rail of the "belly or horizontally bent form"
Figure 9B:
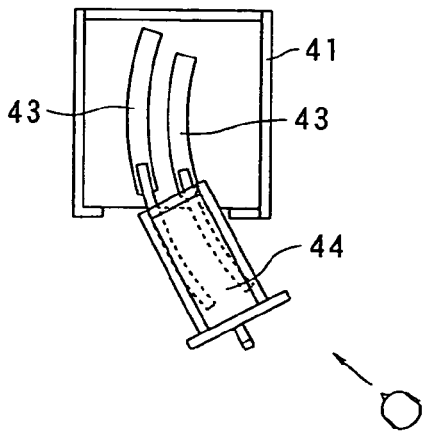
FIG. 9B shows the slide rail of the "sword or horizontally bent form"

FIG. 9 (9A, 9B) shows an example in which a general type of a drawer 44 having an upper side opened is pulled out along the circular-arc locus in the horizontal plane. In FIG. 9A, a "belly or horizontally bent formed" slide rails 42 is mounted to both the side surfaces of the drawer 44 and the body 41, and on the other hand, in FIG. 9B, a "sword or horizontally bent formed" slide rail 43 is mounted to the lower surface of the drawer 44 and the body 41. In this example, when the user pulls out the drawer 44 from a position apart from the front side portion of the drawer 44, if the drawer 44 is formed to be capable of being pulled out along the circular-arc locus, the user can easily pull out the drawer 44 as like as to forwardly open a door. This example may be particularly applicable in a case where the drawer 44 exists very near a wall surface, namely, the user can pull out the drawer 44 while the user is apart from the wall surface. As mentioned above, by designing the drawer so as to be pulled out along the circular-arc locus as compared with the linear locus which is regarded as usual, degree of freedom for designing the drawers and the usable range thereof can be remarkably widened.

Figures 10A, 10B, 10C:
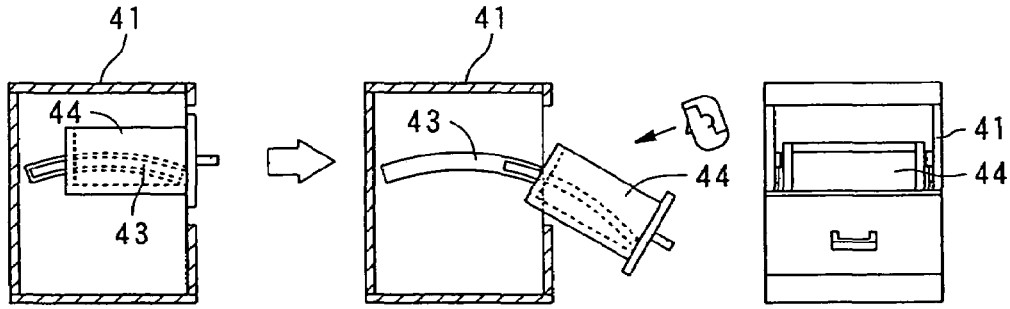
FIG. 10A is a side view showing the drawer accommodated state.
FIG. 10B is a side view showing the drawer pulled-out state.
FIG. 10C is a front view showing the drawer accommodated state.

FIG. 10 shows an example in which the drawer can be pulled out along the circular-arc locus in a vertical plane. In this example, the slide rail 43 in the "sword or vertically bent form" is mounted between the side surface of the drawer 44 and the side surface of the body 41. FIG. 10A shows a side view of the drawer 44 in the accommodated state, and FIG. 10B shows a side view of the drawer 44 in the pulled-out state. In this example, at the time when the drawer 44 is pulled out, a large gap in the vertical direction can be provided between the drawer 44 and the opened side portion of the body 41 in which the drawer 44 is accommodated, so that the drawer 44 can be pulled out in an inclined state, hence, articles and the like can be easily put in or out of the drawer 44, and the user can easily observe the inside of the drawer 44.

Figure 11:
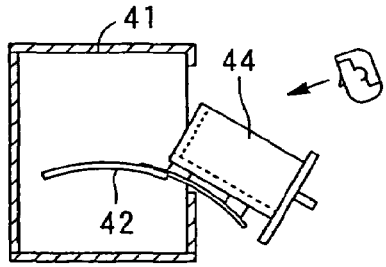
FIG. 11 shows a side view of an example in which the drawer is pulled out along the circular-arc locus in the vertical plane.

FIG. 11 also shows an example in which the drawer 44 is pulled out along the circular-arc locus in the vertical plane. In this example, the slide rail 42 in the "belly or vertically bent form" is mounted between the lower surface of the drawer 44 and the body 41. In this example, at the time when the drawer 44 is pulled out, a large gap in the vertical direction can be provided between the drawer 44 and the opened side portion of the body 41 in which the drawer 44 is accommodated, so that the drawer 44 can be pulled out in an inclined state, hence, articles and the like can be easily put in or out of the drawer 44, and the user can easily observe the inside of the drawer 44.

Figures 12A, 12B, 12C:
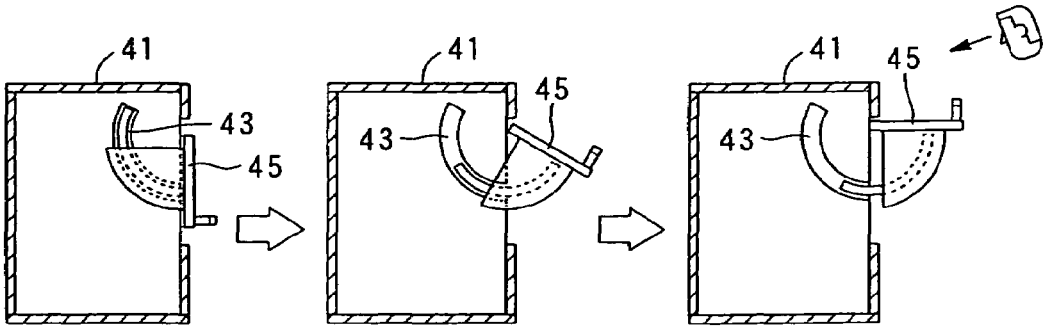
FIG. 12A is a side view showing the panel before pulled out.
FIG. 12B is a side view of the panel during pulled out.
FIG. 12C is a side view of the panel after pulled out.

FIG. 12 shows an example in which a panel 45 is pulled out along the circular-arc locus in the vertical plane. In this example, the slide rail 43 in the "sword or vertically bent form" is mounted between the side surface of the panel 45 and the side surface of the body 41. FIG. 12A shows a side view of the panel 45 before the pulled-out state, FIG. 12B is a side view showing a just pulling-out state, and FIG. 12C is a side view after the pulled-out state. The panel 45 before the pulled-out state is positioned in the vertical plane, but it is positioned in the horizontal plane by pulling-out. Thus, the pulled-out panel 45 may be used as, for example, a table, or when it is utilized as a touch-panel used, for example, as an operation board, the operation board can be easily observed and operated.

Figures 13A, 13B, 13C:
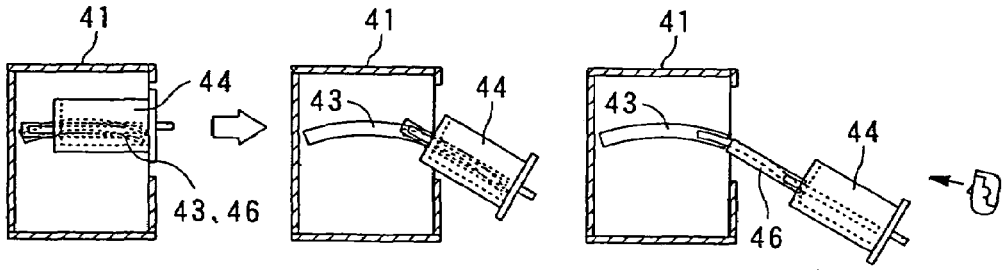
FIG. 13A is a side view showing the a drawer before pulled out.
FIG. 13B is a side view of the drawer during pulled out.
FIG. 13C is a side view of the drawer after pulled out.

FIG. 13 represents an example showing a combination of a linear slide rail 46 and the circular-arc slide rail 43. FIGS. 13A, 13B and 13C are side views respectively showing the drawers 44 before the pulled-out state, in a just pulling-out state, and after the pulled-out state. In this example, one of the outer rail 1 and inner rail 2 of the sword or vertically bent slide rail 43 is bonded to one of the outer rail and inner rail of a linear slide rail 46 of conventional structure. When the drawer 44 is pulled out from the position shown in FIG. 13A, the circular-arc shaped slide rail 43 is first operated, and the drawer 44 is moved along the circular-arc locus as shown in FIG. 13B. In this operation, the operation of the linear slide rail 46 is locked. When the drawer 44 is further pulled out, the drawer 44 is linearly pulled out downward as shown in FIG. 13C. This example may be preferably applied to, for example, a drawer of a system kitchen which is located to an upper portion in the kitchen so as to pull out it downward, thus easily putting and pulling articles in and out of the drawer 44.

Figures 14A, 14B, 14C:
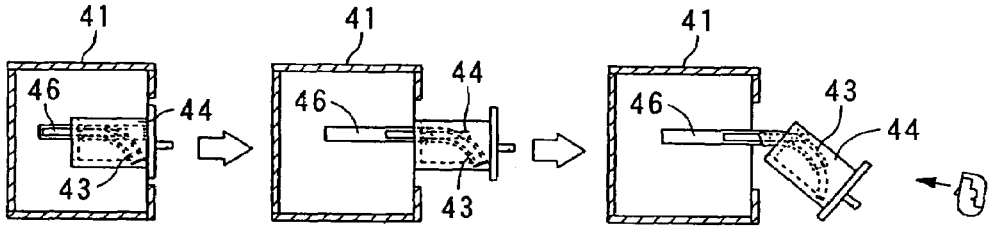
FIG. 14A is a side view showing the a drawer before pulled out.
FIG. 14B is a side view of the drawer during pulled out.
FIG. 14C is a side view of the drawer after pulled out.

FIG. 14 represents an example showing a combination of the linear slide rail 46 and the circular-arc slide rail 43. FIGS. 14A, 14B and 14C are side views respectively showing the drawers 44 before the pulled-out state, in a just pulling-out state, and after the pulled-out state. In this example, one of the outer rail 1 and inner rail 2 of the "sword or vertically bent formed" slide rail 43 is bonded to one of the outer rail and inner rail of a linear slide rail 46 of conventional structure. When the drawer 44 is pulled out from the position shown in FIG. 14A, the linear slide rail 46 is first operated, and the drawer 44 is moved linearly in the horizontal direction as shown in FIG. 14B. In this operation, the operation of the circular-arc shaped slide rail 43 is locked. When the drawer 44 is further pulled out, the drawer 44 is moved downward along the circular-arc locus as shown in FIG. 14C. This example may be preferably applied to, for example, a drawer of a system kitchen which is located to an upper portion in the kitchen so as to pull out it downward, thus easily putting and pulling articles in and out of the drawer 44.

Further, it is to be noted that the present invention is not limited to the described embodiments, and many various changes and modifications may be made without departing from the scopes of the appended claims. For example, the drawer of the structure mentioned above of the present invention may be applied, other than the furniture, to toner exchanging mechanism of a copy machine, open/close mechanism of an emergency door or any other mechanisms for object which are to be pulled out. Rollers may be utilized in place of balls. Furthermore, relatively movable outer and inner rail combination structure may be also applied with no rolling members interposed between the outer and inner rails.

It should be understood that various alternatives to the embodiments of the invention described herein may be employed in practicing the invention. Thus, it is intended that the following claims define the scope of the invention and that methods and structures within the scope of these claims and their equivalents be covered thereby.

The entire disclosure of Japanese Patent Application No. 2003-197393 filed on Jul. 15, 2003 including the specification, claims, drawings and abstract is incorporated herein by reference in its entirety.

What is claimed is:

1. A slide rail unit, comprising:

a body side rail attached to a body in which an object is accommodated; and an object side rail attached to the object and slidable relative to the body side rail; and a retainer interposed between the body side rail and the object side rail to retain a rolling member between the body side rail and the object side rail, the rolling member rolling between the body side rail and the object side rail when the object side rail and the body side rail slide relative to each other, the retainer having a bottom wall section extending in a longitudinal direction of the retainer and having a pair of arm-shaped sections extending upward from respective ends in a width direction of the bottom wall section, wherein the body side rail and the object side rail are bent around an axis perpendicular to a width direction of the body side rail and object side rail, and one of said body side rail and said object side rail is fitted to an inside portion of an other of said body side rail and said object side rail, such that said one of said body side rail and said object side rail fitted to the inside portion is slidable relative to the other of said body side rail and said object side rail, and said body side rail and said object side rail each have a portion bent in a circular arc shape to guide the object so that the relative sliding of the body side rail and the object side rail guide the object along a circular arc locus out from the body in which the object is accommodated.

2. A slide rail unit according to claim 1, wherein said body side rail is an outer rail, said outer rail comprising a bottom wall section extending in circular-arc shape in a longitudinal direction thereof and a pair of side wall sections formed, in a bent form, on both side ends in the short length direction of the bottom wall section so as to extend in circular-arc shape in the longitudinal direction thereof to thereby form a rolling member rolling portion, and said object side rail is an inner rail fitted to the outer rail, said inner rail comprising a bottom wall section extending in parallel to the bottom wall section of the outer rail and a pair of side wall sections formed, in a bent form, on both side ends in the short length direction of the bottom wall section so as to extend in circular-arc shape in the longitudinal direction thereof to thereby form a rolling member rolling portion; and further comprising a plurality of rolling members disposed between the rolling member rolling portion of the outer rail and the rolling member rolling portion of the inner rail.

3. A slide rail unit according to claim 2, wherein said outer rail is bent in the circular-arc shape in a virtual plane including the bottom wall section of the outer rail, and said inner rail is bent in the circular-arc shape in a virtual plane including the bottom wall section of the inner rail.

4. A slide rail unit according to claim 2, wherein said inner rail has a cross sectional shape corresponding to an inverted shape for a cross section of the outer rail and the inner rail is fitted to the outer rail to thereby define a rolling member rolling path therebetween.

5. A slide rail unit according to claim 2, wherein said plurality of rolling members are balls.

6. A slide rail according to claim 2, wherein the retainer has a curved configuration conforming to the curve of the circular arc shape of said outer rail.

7. A slide rail unit according to claim 1, wherein said circular-arc locus has a predetermined radius of curvature.

8. A slide rail unit according to claim 1, wherein said object side rail is an outer rail, said outer rail comprising a bottom wall section extending in circular-arc shape in a longitudinal direction thereof and a pair of side wall sections formed, in a bent form, on both side ends in the short length direction of the bottom wall section so as to extend in circular-arc shape in the longitudinal direction thereof to thereby form a rolling member rolling portion, and said body side rail is an inner rail fitted to the outer rail, said inner rail comprising a bottom wall section extending in parallel to the bottom wall section of the outer rail and a pair of side wall sections formed, in a bent form, on both side ends in the short length direction of the bottom wall section so as to extend in circular-arc shape in the longitudinal direction thereof to thereby form a rolling member rolling portion; and further comprising a plurality of rolling members disposed between the rolling member rolling portion of the outer rail and the rolling member rolling portion of the inner rail.

9. A slide rail unit according to claim 8, wherein said outer rail is bent in the circular-arc shape in a virtual plane including the bottom wall section of the outer rail, and said inner rail is bent in the circular-arc shape in a virtual plane including the bottom wall section of the inner rail.

10. A slide rail unit according to claim 8, wherein said inner rail has a cross sectional shape corresponding to an inverted shape for a cross section of the outer rail and the inner rail is fitted to the outer rail to thereby define a rolling member rolling path therebetween.

11. A slide rail unit according to claim 8, wherein said plurality of rolling members are balls.

12. A slide rail according to claim 1, wherein the bottom wall section of the retainer comprises:

an inverted groove-shaped portion extending in the longitudinal direction of the retainer, the inverted groove-shaped portion having a side wall section; and connection portions between the side wall section and the respective arm-shaped sections, connecting the inverted groove shaped portion and the arm-shaped sections.

13. A slide rail according to claim 12, wherein the inverted groove-shaped portion includes holes formed at a constant pitch in a longitudinal direction of the groove-shaped portion.

14. A slide rail according to claim 12, wherein the rolling member includes a plurality of balls, and the plurality of balls are rotatably held by the arm-shaped sections at equal intervals; and the retainer further comprises:

a cutout formed, between adjacent balls, to the arm-shaped sections and the connection portions; and slits formed continuous to the cutout and extending in a width direction of the retainer to pass through one side wall section of the inverted groove-shaped portion and a bottom portion of the inverted groove-shaped section.

15. A slide rail according to claim 1, wherein the rolling member includes a plurality of balls, and the plurality of balls are rotatably held by the arm-shaped sections at equal intervals.

16. A slide rail according to claim 15, wherein the arm-shaped sections respectively include openings for receiving the plurality of balls, and the openings have a diameter slightly smaller than a diameter of the balls.

* * * * *